United States Patent [19]

Shimada

[11] Patent Number: 4,592,088

[45] Date of Patent: May 27, 1986

[54] SPEAKER APPARATUS

[75] Inventor: Yasuomi Shimada, Katano, Japan

[73] Assignee: Matsushita Electric Industrial Co., Ltd., Osaka, Japan

[21] Appl. No.: 621,917

[22] PCT Filed: Oct. 13, 1983

[86] PCT No.: PCT/JP83/00345

§ 371 Date: Jun. 12, 1984

§ 102(e) Date: Jun. 12, 1984

[87] PCT Pub. No.: WO84/01682

PCT Pub. Date: Apr. 26, 1984

[30] Foreign Application Priority Data

Oct. 14, 1982 [JP] Japan ..... 57-180705
Nov. 15, 1982 [JP] Japan ..... 57-201341
Nov. 15, 1982 [JP] Japan ..... 57-201353

[51] Int. Cl.[4] ..... H04R 1/02; H04R 3/04; H04R 29/00

[52] U.S. Cl. ..... 381/90; 381/59; 381/96

[58] Field of Search ..... 381/90, 59, 56

[56] References Cited

U.S. PATENT DOCUMENTS 4,100,380 7/1978 Gosswiller ..... 381/59
4,268,719 5/1981 Manger ..... 381/59
4,276,443 6/1981 Meyers ..... 381/96
4,395,588 7/1983 Franssen et al. ..... 381/96

FOREIGN PATENT DOCUMENTS 2141141 2/1973 Fed. Rep. of Germany ..... 381/96
57-188198 11/1982 Japan ..... 381/96
7609200 2/1978 Netherlands ..... 381/96

*Primary Examiner*—Gene Z. Rubinson
*Assistant Examiner*—Danita R. Byrd
*Attorney, Agent, or Firm*—Spencer & Frank

[57] ABSTRACT

A speaker apparatus using the so-called motional feedback (MFB) technique in which the sound wave from a speaker (14) is detected by a microphone (10) and the output of the microphone (10) is fed back to a power amplifier (5) for driving the speaker through a feedback amplifier (11). The microphone (10) is disposed in a plane which is perpendicular to the sound radiation axis of the speaker such plane containing substantially the acoustic center of the speaker (14). The output of the microphone (10) is fed back to the power amplifier (5) within a frequency range lower than a frequency at which the distance between the speaker (14) and the microphone (10) becomes $\frac{1}{4}$ wavelength. A speaker apparatus is thus realized where the reproduced sound is not influenced by the microphone, the feedback upper limit frequency is high and the influence of Doppler distortion is small.

11 Claims, 20 Drawing Figures

SPEAKER APPARATUS

TECHNICAL FIELD

This invention relates to a speaker apparatus where the sound pressure characteristic of a speaker is controlled by MFB (Motional Feed Back) whereby the lowest resonance frequency is decreased so that the reproduction capability in the low frequency range is improved.

BACKGROUND ART

The so-called MFB technique has been known, according to which the acceleration of the diaphragm of a speaker is detected by a certain method and the detected output is negatively fed back to a power amplifier thereby to lower the lowest resonance frequency of the speaker.

In the case when a microphone is used a method for detecting the acceleration of the diaphragm of a speaker, an angle arm is provided in front of the diaphragm. The microphone is fixed in the center part of the angle arm and the sound pressure reproduced by the diaphragm is detected by the microphone. This method has the advantage of detecting vibration without any contact between the diaphragm and the microphone. However, according to the above method, the angle arm for fixing the microphone which protrudes in front of the diaphragm disturbs the radiation of sound; the angle arm resonates; the external appearance is undesirable; and furthermore, since the speaker and the microphone should be always built in as a pair, there is a problem that the freedom of design is limited.

Especially, after MFB is applied, the low frequency region is enhanced and the displacement of the diaphragm increases. In order to avoid any touch of the diaphragm with the angle arm, the angle arm should be kept at a distance from the diaphragm. However, if this is done, there arises a problem that the feedback upper-limit frequency (the maximum frequency at which the amount of feedback becomes 0 dB) becomes low since the rotation of the phase of sound waves from the diaphragm to the microphone increases. Moreover, if the microphone is provided in front of the speaker, the influence of the so-called Doppler distortion due to the Doppler is unavoidable.

SUMMARY OF THE INVENTION

It is an object of the invention to provide a speaker apparatus wherein the detection by a microphone scarcely influences the reproduction on sound; limitation of design is small; design is excellent; and furthermore, the feedback upperlimit frequency can be increased and the influence of Doppler distortion is small.

The above and other objects are accomplished according to the invention by the provision of a speaker apparatus comprising an input terminal for receiving an input signal; a speaker for radiating a sound wave, the speaker having a sound wave radiation axis; a power amplifier connected between the input terminal and the speaker for driving the speaker to produce a sound wave; a feedback amplifier; a microphone for detecting the sound wave from the speaker and connected to the power amplifier via the feedback amplifier for feeding back to the power amplifier a feedback signal which has a frequency range below an upper limit frequency, the microphone being disposed in a plane which is substantially perpendicular to the direction of the sound wave radiation axis, and wherein said plane substantially contains an acoustic center of the speaker and the microphone is located at a distance from the sound radiation axis which is not greater than $\frac{1}{4}$ of the wavelength corresponding to the upper limit frequency of the feedback signal.

DESCRIPTION OF THE PREFERRED EMBODIMENTS

Figure 1:
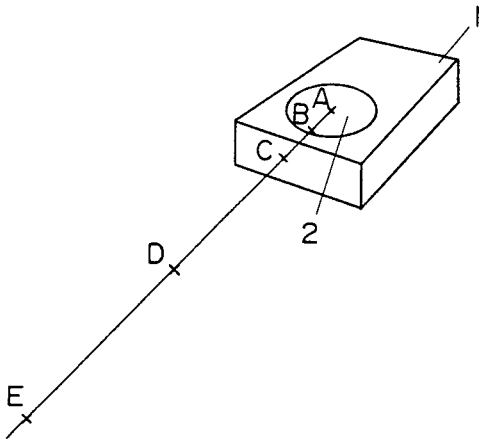
FIG. 1 is a perspective view for explaining the principle of this invention.
Figure 2:
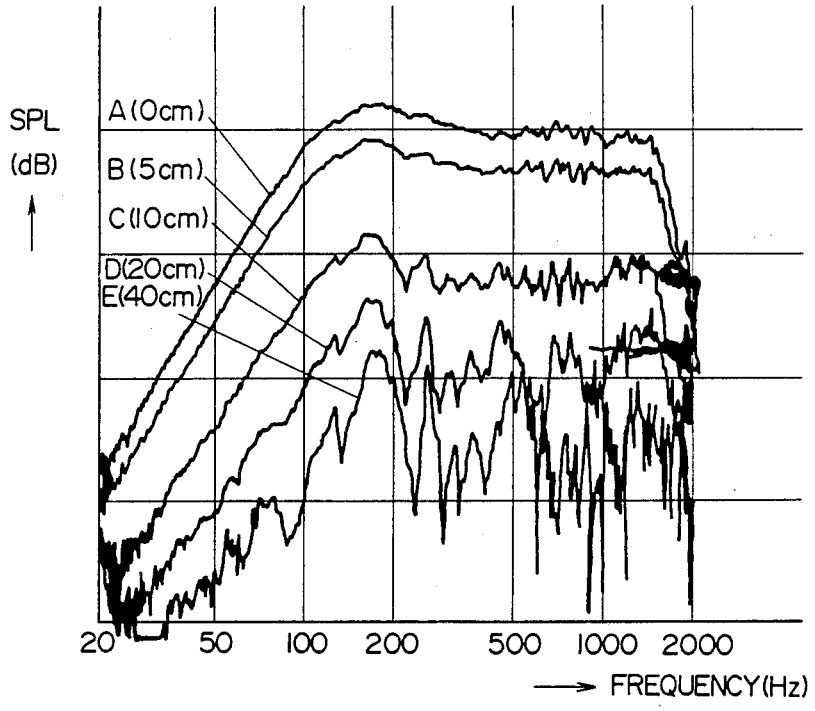
FIG. 2 is a diagram of sound pressure-frequency characteristic at points A–E in FIG. 1.

FIG. 1 shows the arrangement of measuring the radiation sound pressure of a speaker 2 on a baffle plate of a speaker box 1, strictly speaking, at a height of 1 cm from the surface of the baffle plate, by placing a microphone at points A, B, C, D and E marked by x in the figure. Each point A, B, C, D and E lies in a plane in which is approximately perpendicular to the sound radiation direction of the speaker 2 and which contains substantially the acoustic center of the speaker 2. FIG. 2 shows the sound pressure-frequency characteristics at points A, B, C, D and E. The ordinate is the sound pressure, while the abscissa is the frequency. As apparent from FIG. 2, even in the direction of 90° from the sound radiation axis of the speaker 2, the frequency characteristic is not so much different from the characteristic at the point A on the sound radiation axis. This means that it is not always necessary to place the microphone in close contact with the speaker 2 on its sound radiation axis, as has been conventionally considered, to detect the vibration characteristic of the speaker 2. However it is necessary that the phase rotation should not exceed 90° in order to apply feedback. Therefore, the distance between the microphone and the speaker 2 can be increased up to a range not exceeding $\frac{1}{4}$ of the wavelength at the feedback upper-limit frequency. If this princple is utilized, the microphone can be set with large versatility. In the case of applying MFB to the speaker 2, it is not always necessary to provide the microphone within either a speaker box 1 or a speaker driver unit. Thus, it becomes allowable to mount the microphone on an adapter prepared as an external adapter, when MFB is applied to a conventional speaker which is already used by a user.

If we consider that the sound velocity is 340 m/s and negative feedback is applied to the speaker 2 up to 340 Hz, the microphone can be separated from the speaker 13 as far as 25 cm which is equal to $\frac{1}{4}$ wavelength. Furthermore, from FIG. 2, we may consider that up to the point D (20 cm) the frequency characteristic below 200 Hz is nearly the same as that at the point A. Therefore, it is desirable to set the feedback upper limit frequency at 200–300 Hz and the distance between the microphone and the speaker 2 within 20–25 cm.

Figure 3:
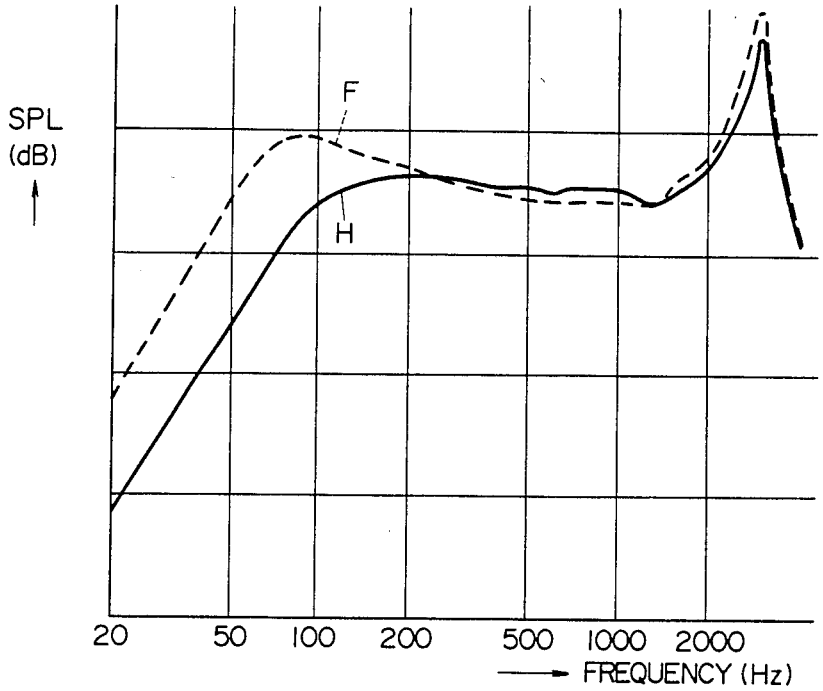
FIG. 3 and FIG. 4 are diagrams of sound pressure-frequency characteristics before and after feedback at points A and C.
Figure 4:
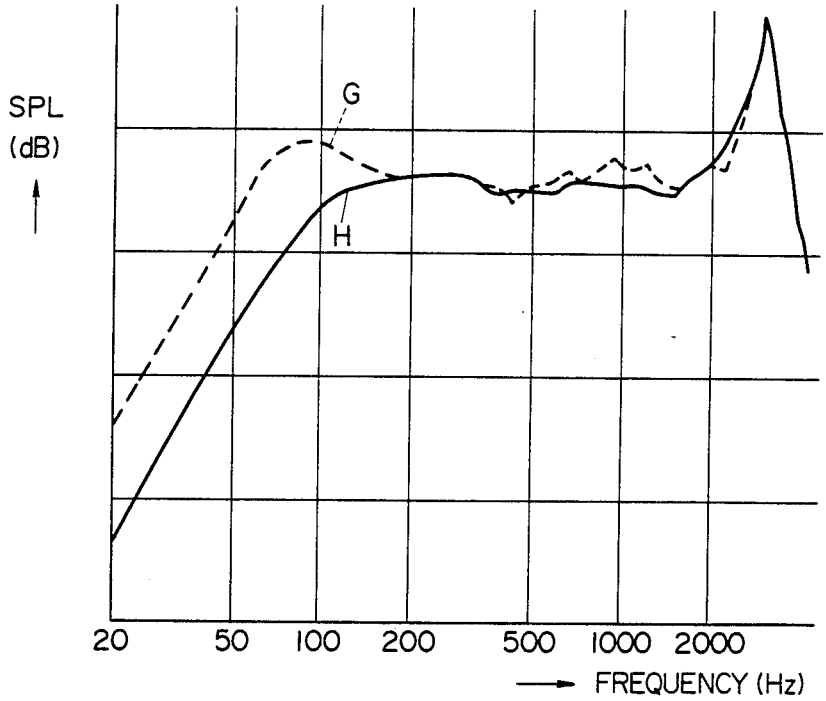

Dashed curves in FIG. 3 and FIG. 4 show the characteristics after feedback at points A and C. In both cases, only the amount of feedback $\beta$ is adjusted so that the frequency characteristics after feedback at points A and C are substantially the same. In FIG. 3 and FIG. 4, F and G denote sound pressures after feedback while H denotes sound pressure without MFB.

Figure 5:
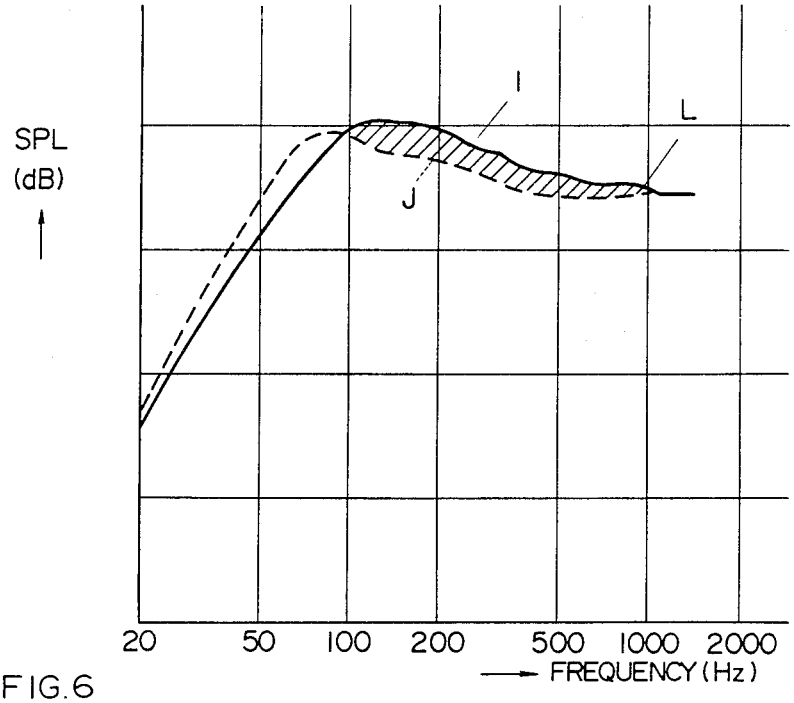
FIG. 5 and FIG. 6 are diagrams of sound pressure-frequency characteristics showing the amount of feedback in FIG. 3 and FIG. 4.
Figure 6:
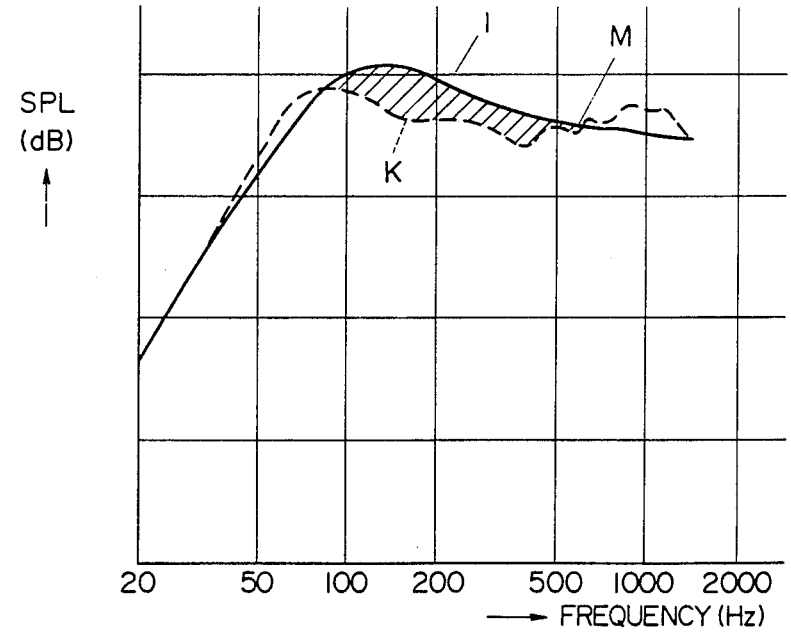

FIG. 5 and FIG. 6 show amounts of feedback in the states of FIG. 3 and FIG. 4, respectively. I denotes sound pressure without MFB. J and K denote sound pressures with MFB. Shaded regions correspond to negative feedback, while the other regions correspond to positive feedback. The feedback upper limit frequencies are denoted by L and M, respectively.

Figure 7:
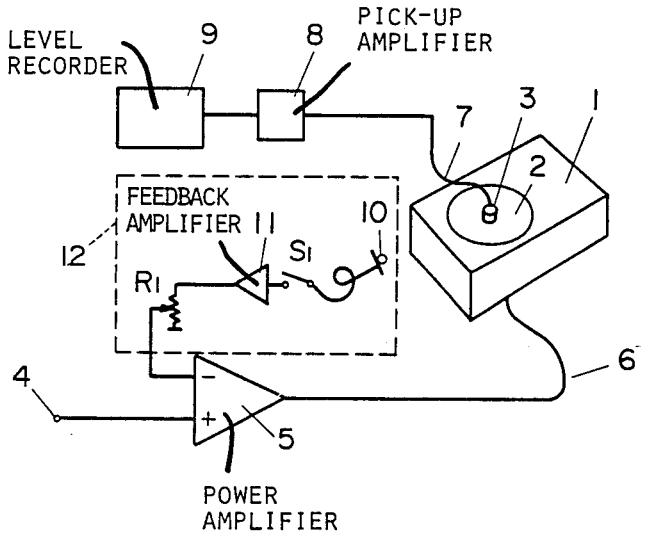
FIG. 7 is a block diagram for explaining the principle of measuring the sound pressure-frequency characteristics.

A block diagram for the actual measurement is shown in FIG. 7. An acceleration pick-up 3 is fixed on the center part of the diaphragm of a speaker 2. The frequency of an input signal, which is supplied to the speaker 2 from an input terminal 4 through a power amplifier 5 and a speaker cord 6, is swept and the acceleration of the diaphragm at each frequency is detected by the pick-up 3. The output is drawn on a level recorder 9 through a pick-up cable 7 and a pick-up amplifier 8. If a switch $S_1$ is closed, MFB is applied through a microphone 10, the switch $S_1$, a feedback amplifier 11, and a variable resistor $R_1$. The amount of feedback $\beta$ is varied by the variable resistor $R_1$.

Therefore, if the feedback circuit composed of the microphone 10, switch $S_1$, feedback amplifier 11 and variable resistor $R_1$, etc. in FIG. 7 is unified as an adapter 12, MFB can be easiy applied to the conventional speaker having no MFB function.

Figure 8:
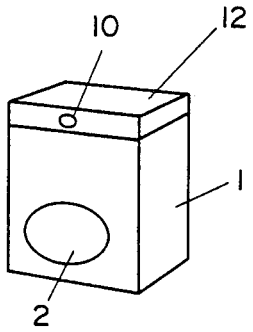
FIG. 8 is a perspective view of a first embodiment of this invention.

FIG. 8 shows a first embodiment of this invention to which the above-mentioned principle is applied. An adapter 12 is placed in the vicinity of a speaker. A feedback circuit composed of the microphone 10, switch $S_1$, feedback amplifier 11 and variable resistor $R_1$, etc., as shown in FIG. 7, is built into the adapter 12. In this way, an MFB speaker can be constituted simply. Although it is desirable that the adapter 12 be positioned in the vicinity of the speaker box 1 as near as possible, it is not always necessary to make it in intimate contact with the speaker box 1. Freedom of placement is extremely large.

Furthermore, if the adapter 12 is kept at a distance from the speaker 2 and the amount of feedback is set less than or equal to a certain value in spite of a phase rotation at high frequencies, the received sound pressure of the microphone 10 decreases in accordance with the distance from the speaker 2. The amount of feedback decreases automatically. Therefore, problems such as oscillation do not occur. Namely, the amount of feedback should be set less than or equal to 0 dB at a frequency where the difference between the phases of the reproduced sound of speaker 2 and of the detected signal of microphone 10 becomes larger than or equal to 90°.

Figure 9:
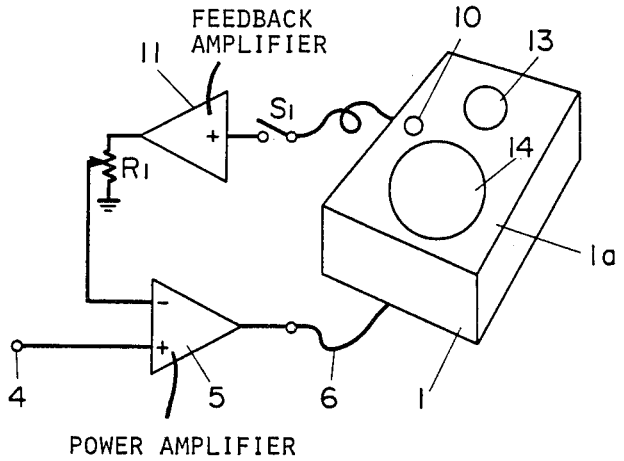
FIG. 9 is a perspective view of a second embodiment of this invention.
Figure 10:
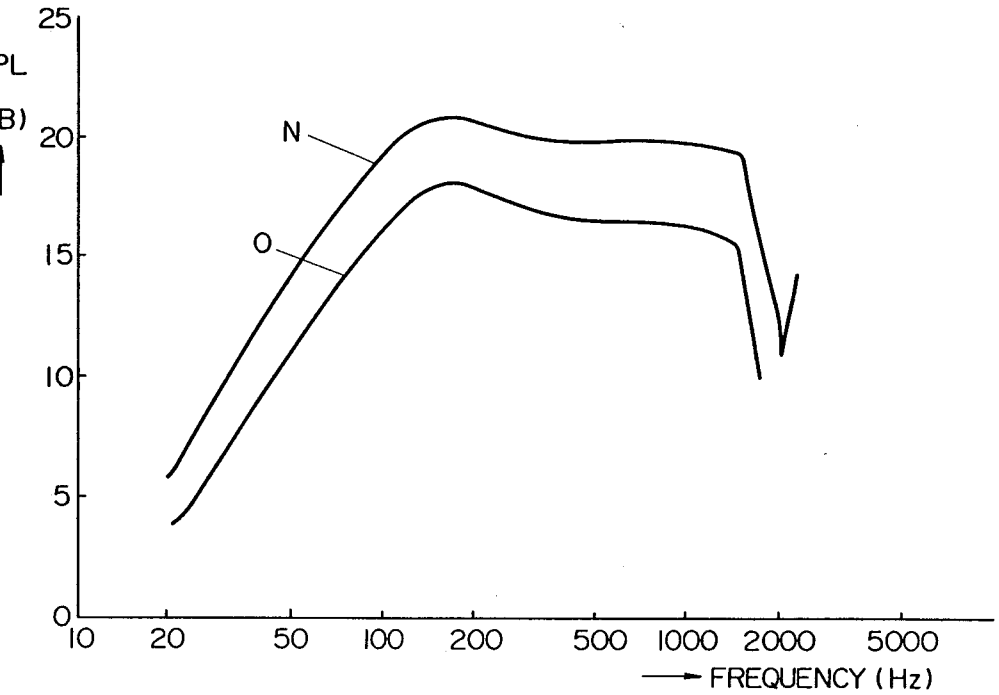
FIG. 10 is a diagram of sound pressure-frequency characteristic of the embodiment of FIG. 9.
Figure 11:
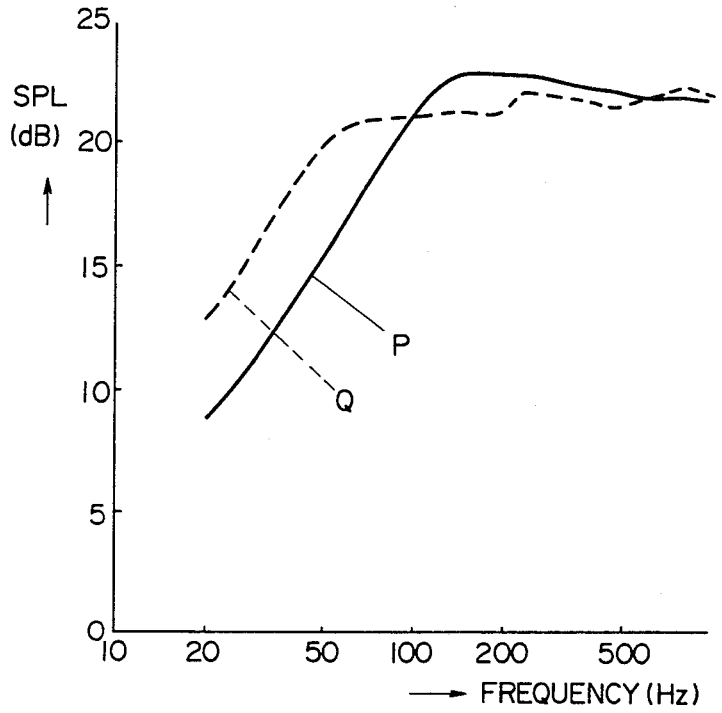
FIG. 11 is a diagram of sound pressure-frequency characteristics before and after feedback in the embodiment of FIG. 9.

A second embodiment of this invention is shown in FIGS. 9 to 11. In FIG. 9, the same reference numerals are used to denote the parts with the same function. Explanation of them is therefore omitted. On a baffle plate 1a of a speaker box 1, a speaker 14 for low-pitched tone (hereinafter called a woofer) and a speaker 13 for high-pitched tone (hereinafter called a tweeter) are mounted. A microphone 10 is mounted in the vicinity of the diaphragm of woofer 14 on the baffle plate 1*a* of speaker box 1.

FIG. 10 shows the sound pressure-frequency characteristic actually measured by the apparatus of FIG. 9. N denotes measured data in the case where the microphone is disposed on the position of 1 cm on the sound radiation axis of woofer 14 while O denotes data in the case where the microphone is disposed at a position of 1 cm above the baffle plate 1*a* of the speaker box 1, distanced by 8 cm from the sound radiation axis of woofer 14 in a plane perpendicular to the axis. As apparent from this figure, N and O have nearly a similar pattern. Namely, it is seen that not only the position with the characteristic N but also the position with the characteristic O is satisfactory as the detecting position of microphone 10 to control the speaker. With consideration of the phases (temporal difference) of the diaphragm of the speaker and the detected signal of microphone 10, it is apparent from the feedback theory that the phase difference becomes less than or equal to 90° and negative feedback results in if the distance between the speaker and the microphone 10 is less than or equal to a $\frac{1}{4}$ wavelength at the feedback upper-limit frequency. Therefore, when the microphone 10 and the speaker are separated by 8 cm, a negative feedback may be applied up to 1 KHz since the phase difference bcomes 90° at 1.06 KHz.

In FIG. 9, if the switch $S_1$ is closed, the microphone 10 detects the signal which is proportional to the reproduced sound pressure of woofer 14 and the detected signal is introduced to a feedback amplifier 11 through the switch $S_1$. A prescribed quantity is fed back to the input of a power amplifier 5 and hence an MFB is applied.

FIG. 11 shows the sound pressure-frequency characteristic before and after feedback in the embodiment of FIG. 9. The abscissa is the frequency and the ordinate is the sound pressure. P denotes the sound pressure-frequency characteristic before feedback while Q denotes the sound pressure-frequency characteristic after feedback. As apparent from FIG. 11, if the lowest resonance frequency is decreased by the application of MFB, the sound pressure characteristic is improved.

In this case, although the microphone may be disposed at any position on the baffle 1*a*, it is desirable that it be in the vicinity of the speaker in view of the phase difference between the speaker and the microphone 10, which is not to exceed 90° at the feedback upper limit frequency and the detection sensitivity of the microphone.

In this manner, when the microphone 10 is mounted on the baffle plate 1*a* of the speaker box 1 and MFB is applied, a use of the speakers 13, 14 having such a flat diaphragm that the distortions of reproduced sounds near the diaphragm and at the receiving point substantially coincide with each other can yield an effect of decreasing the distortion of reproduced sound also at the audience point.

Further, in radio receivers and tape recorders, etc., if a speaker is mounted on the front panel of the cabinet, the front panel can be taken as the baffle plate of the speaker box. Therefore, in such a case, the microphone may be mounted on the front panel of the cabinet.

Furthermore, in a speaker apparatus of the bass reflex type in which it has been considered to be difficult to apply MFB because the characteristic after feedback is unstable, a microphone for MFB may be mounted on the baffle plate of the speaker box so that the reproduced sound from the diaphragm and the bass reflex point is detected by this microphone to control the speaker. Then, a speaker apparatus of bass reflex type with a stable characteristic can be realized.

Figure 12:
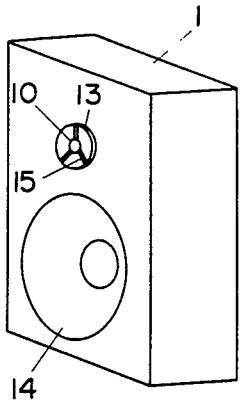
FIG. 12 is a perspective view of a third embodiment of this invention.
Figure 13:
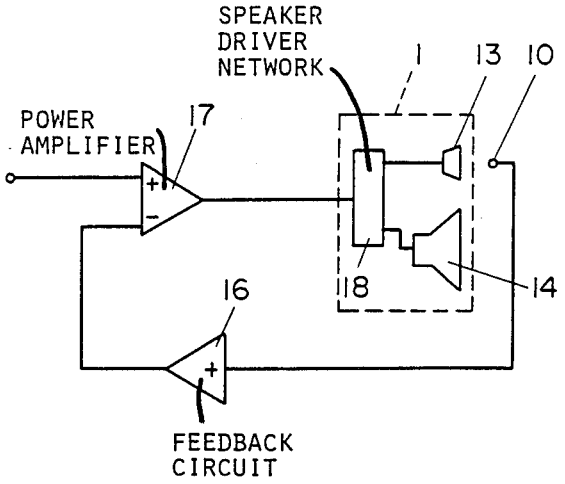
FIG. 13 is a block diagram of the embodiment of FIG. 12.
Figure 14:
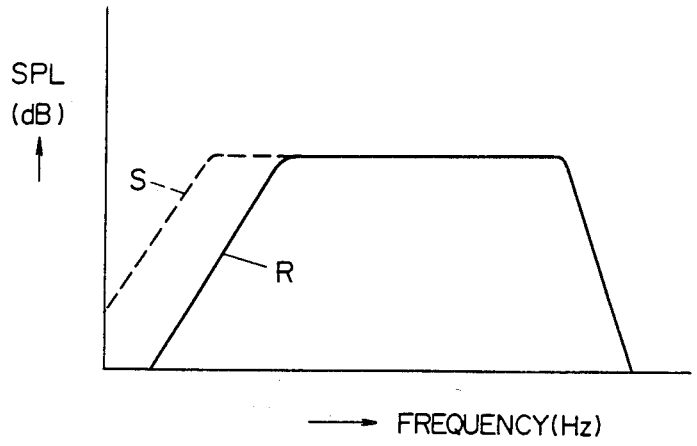
FIG. 14 is a diagram of sound pressure-frequency characteristic of the embodiment of FIG. 12.

A third embodiment of this invention is shown in FIGS. 12 to 14. Namely, in FIG. 12, tweeter 13 and woofer 14 are built in a speaker box 1. A microphone 10 is provided near the center of an equalizer grille 15 for the tweeter. This microphone 10 detects both the reproduced sound of tweeter 13 and the reproduced sound of woofer 14 which are fed back to an inverting input of a power amplifier 17 through a feedback circuit 16 as shown in FIG. 13. Reference numeral 18 denotes a speaker driver network which drives the tweeter 13 and the woofer 14.

In this constitution, since the microphone 10 detects sounds in the whole reproduction frequency range from low-pitched tone to high-pitched tone, the so-called acceleration feedback is applied to the tweeter 13 and the woofer 14. Distortions of tweeter 13 and woofer 14 are reduced by the amount of feedback. Especially, in the woofer 14, the lowest resonance frequency in the lower frequency range is lowered. This situation is shown in FIG. 14. The abscissa is the frequency and the ordinate is the sound pressure. Solid curve R denotes the characteristic before feedback while dashed curve S denotes the characteristic after feedback. It is apparent that the lowest resonance frequency in the lower frequency range is lowered.

For mounting the above-mentioned microphone 10, it is known to provide a stand or angle arm in front of the woofer 14. However, such a stand or angle arm resonates by receiving the radiation sound of the speaker, reflects it and causes irregular disturbance on the frequency characteristic. Furthermore, as the wavelength becomes short in the higher frequency range, and when the distance between the tweeter 13 and the microphone 10 becomes large, the phase rotates and feedback is not applicable. Assuming a sound velocity of 340 m/s, when the tweeter 13 and the microphone 10 are separated by 8.5 cm (corresponding to ¼ wavelength at 1 KHz), the phase exceeds 90° above 1 KHz and positive feedback appears. The appearance of the negative feedback is thus limited to below 1 KHz in this example. However, as shown in this embodiment, when the microphone 10 is provided at the acoustic center on the axis of tweeter 13 ensuring a small phase lag for the high-pitched tone, feedback becomes, in principle, possible as far as the reproduction limiting high frequency of tweeter 13. Furthermore, the tweeter 13 is usually provided with the equalizer grille 15 in order to flatten the frequency characteristic at the receiving point. If a small type microphone 10 is provided at the center of this equalizer grille 15 and the form of equalizer is selected to flatten the frequency characteristic at the receiving point including the microphone 10, the disadvantages of an angle arm, etc. which is placed in front of the woofer 14 can be avoided. In this case, the microphone need not always be mounted on the equalizer grille 15 of tweeter 13. The microphone 10 may be fixed on a stand, or alternatively it may be fixed in a hole which is provided in the center of the diaphragm of tweeter 13. In any case, if the microphone is set in the vicinity of the acoustic center of tweeter 13, feedback can be applied from highpitched to low-pitched tones.

The fact that even if the microphone 10 is provided on a position separated from the sound radiation axis of woofer 14 the microphone 10 can detect correctly the reproduced sound pressure of woofer 14 is apparent from the following. Namely, the directivity of the speaker at low-pitched tones is non-directional; the sound pressure difference between being on the sound radiation axis and being near the speaker being on the order of 1–3 dB; since the wavelength is long, the sound pressure is equal in a wide range of direction; the phase rotation is very small or of a negligible order. If a non-directional microphone is used as the microphone 10, the microphone need not always be directed toward the direction of woofer 14. It is naturally desirable, in this case, to place the microphone 10 as near as possible to the acoustic center of woofer 14 in view of phase and sensitivity characteristics. It is preferable that the tweeter and the woofer are located close to each other, if the directional characteristic of the speaker system at the receiving point is taken into account.

Meanwhile, when the microphone 10 is attached on the tweeter 13 as shown in the embodiment of FIG. 12, there appears a difference of acoustic pressure between the woofer 14 and the tweeter 13. An equalizer, etc. is required to compensate this.

Figure 15:
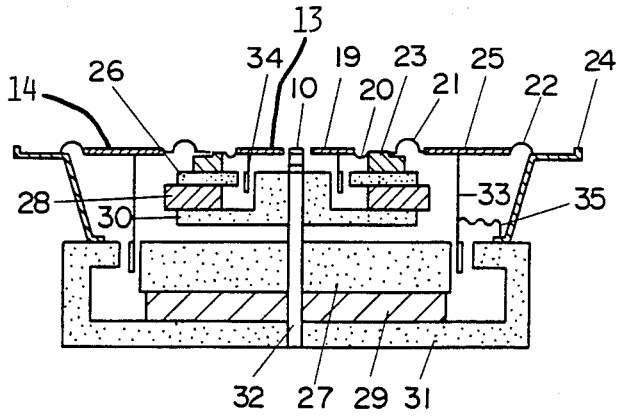
FIG. 15 is a cross-sectional view of a fourth embodiment of this invention.

FIG. 15 shows a fourth embodiment of this invention, where such a problem is solved. In FIG. 15, reference numeral 10 denotes a microphone for MFB, 19 a diaphragm for high-pitched tone, 20, 21, 22 edges, 23, 24 frames, 25 a diaphragm for low-pitched tone, 26, 27 top plates, 28, 29 magnets, 30, 31 yokes, 32 a pipe, 33, 34 voice coil bobbins, and 35 a damper. The relation of connecting the circuit for driving the speaker apparatus of FIG. 15 is similar to that shown in FIG. 13. As apparent from FIG. 15, the only difference is that the tweeter 13 and the woofer 14 of FIG. 15 are coaxially arranged relative to one another.

In the above constitution, the signal is divided into high-pitched tone and low-pitched tone to drive the tweeter 13 and the woofer 14. On the other hand, the microphone 10 provided in the center hole detects the reproduced sound of the tweeter 13 and the woofer 14 and feeds it back to a power amplifier 17 through a feedback circuit 16. With this constitution, it is well known from the MFB theory that as the microphone 10 detects the signal proportional to the acceleration of the speakers 13, 14 the acceleration feedback is applied, the lower reproduction limit frequency of woofer 14 is lowered; and the distortion is reduced by the amount of feedback. Furthermore, since the acoustic centers of tweeter 13 and woofer 14 are at the position of the microphone 10, the reproduction-sound detecting sensitivities of tweeter 13 and woofer 14 are nearly equal. A sensitivity correcting equalizer that has been conventionally necessary for the case when the woofer 14 is distanced from the microphone 10 is not necessary. Since the speaker is of the coaxial type, the inter-modulation distortion that has been the conventional problem is mitigated by the amount of feedback. The harmonic distortion is also improved. Furthermore, since the tweeter 13 and the woofer 14 are disposed concentrically, the directivity characteristic of the speaker is improved in comparison with the conventional multi-unit type. The low frequency region is expanded by the acceleration feedback. Thus, a unique speaker with a high performance can be provided.

Although in this embodiment the microphone is placed in a hole provided in the diaphragm of the speaker for high-pitched tone, the diaphragm need not always be perforated. A similar effect can be obtained as follows. The microphone is placed in the vicinity of the diaphragm near the sound radiation axis of the diaphragm for high-pitched tone under the condition that the phase of the reproduced sound does not rotate much, and is fixed by an acoustic equalizer or a grille of the tweeter 13.

Figure 16:
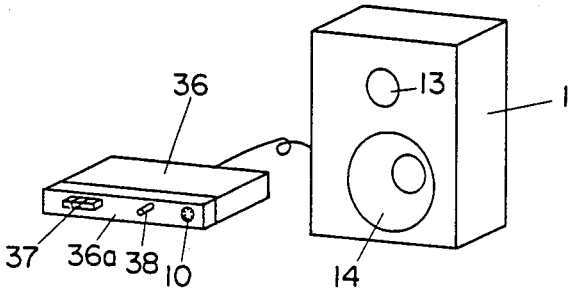
FIG. 16 is a perspective view of a fifth embodiment of this invention.
Figure 17:
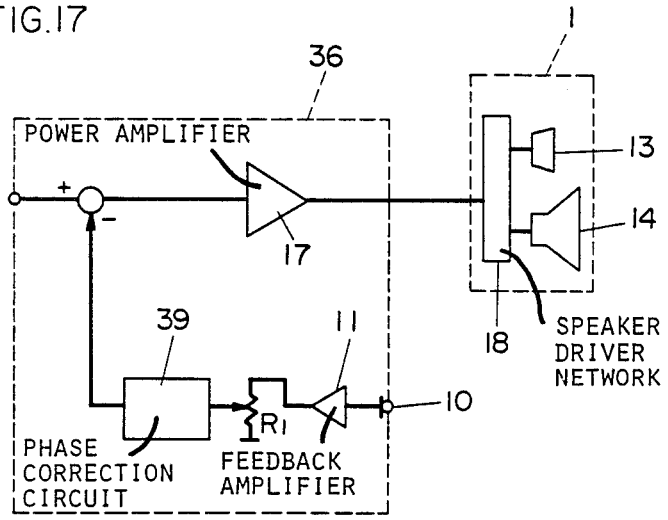
FIG. 17 is a block diagram of the embodiment of FIG. 16.

FIG. 16 and FIG. 17 show a fifth embodiment of this invention, where a microphone 10 for MFB is mounted on a panel 36*a* of an audio apparatus 36. Reference numeral 37 is a switch and 38 is a variable resistor for feedback control. The output terminal of this audio apparatus 36 is connected with an input terminal of a speaker box 1, as shown in FIG. 17. The audio apparatus 36 is placed in the vicinity of the speakers 13, 14. Reproduced sound of the speakers 13, 14 generated from the speaker box 1 is detected by the microphone 10 and fed back to the speakers 13, 14 through the audio apparatus 36. In this case, it is well known that in order to apply a negative feedback the amount of feedback should be set less than or equal to 1 if the phases of the reproduced sound of speakers 13, 14 and the detected sound of the microphone 10 is more than or aqual to 90°. If we take the sound velocity as 340 m/s and apply the negative feedback up to 300 Hz, the distance between the microphone 10 and the speakers 13, 14 should be set within about 28 cm by considering the wavelength.

FIG. 17 is a block diagram of the audio apparatus 36, where the reproduced sound of the speaker 13, 14 is detected by the microphone as an acoustic pressure and applied to an inverting input of the power amplifier 17 through the feedback amplifier 11 and the phase correction circuit 39. The variable resistor $R_1$ for feedback control varies the amount of feedback. If we assume that the gains of the power amplifier 17 and the feedback amplifier 11 are A and $\beta$ respectively, the lowest resonance frequencies of the speakers 13, 14 after feedback decrease in proportion to the inverse of the amount of feedback $1+A\beta$.

With this constitution, the audio apparatus 36 provided with a microphone 10 for MFB and a feedback circuit is mounted in the vicinity of the speaker box 1 without reconstructing the speaker. With a mere connection to the audio apparatus 36, MFB can be applied to the speakers 13, 14. Thus, complexity of MFB system and troubles of wire connections that have been considered heretofore can be solved at once. In a prior art MFB where a vibration detector is mounted on a speaker, disturbance of frequency characteristics due to the diffraction effect and reflection of the speaker box cannot be detected. On the other hand, in this embodiment, since the total acoustic pressure radiated from the speaker box 1 is detected, the frequency characteristic after feedback becomes smooth in proportion to the amount of feedback. Distortions due to bending motion of the diaphragm of a speaker and the noise due to the resonance of the cabinet which cannot be detected by the vibration detector can be detected. Therefore, there is an advantageous decrease in distortion.

Although the embodiment of FIGS. 16 and 17 shows the provision of an MFB microphone in the audio apparatus 36 with the built-in power amplifier 17, it is needless to say that the MFB microphone can be disposed on an arbitrary position of an audio apparatus provided with a preamplifier, an equalizer, a tuner, a tape recorder and a record player other than the power amplifier.

Figure 18:
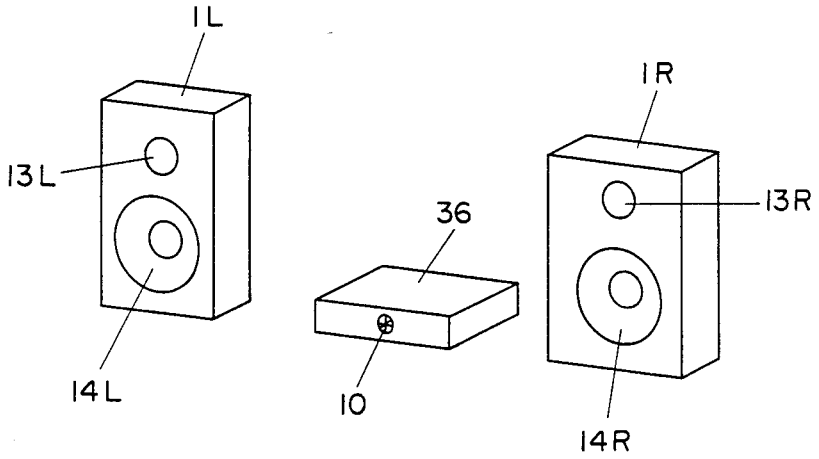
FIG. 18 is a perspective view of a sixth embodiment of this invention.
Figure 19:
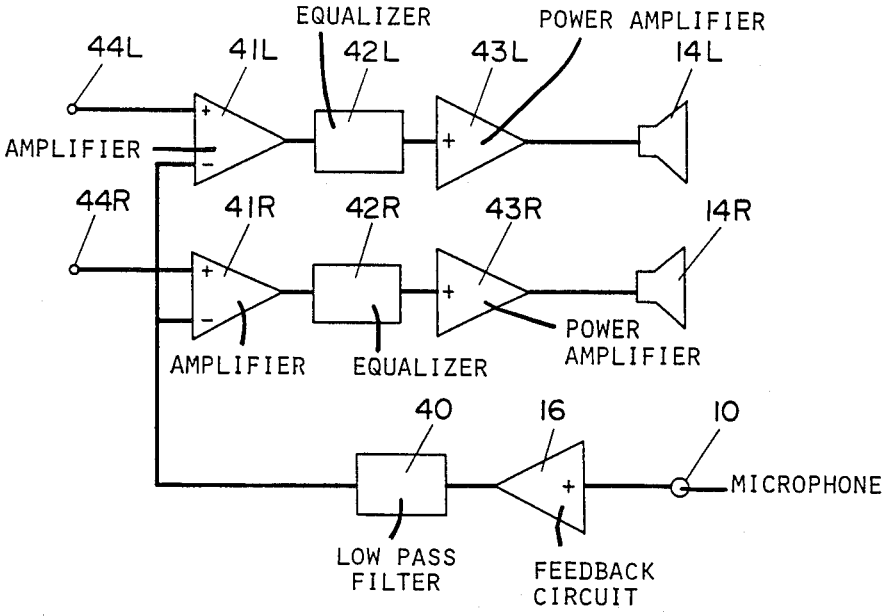
FIG. 19 is a a block diagram of the embodiment of FIG. 18.

A sixth embodiment of this invention is shown in FIGS. 18 and 19. A microphone 10 for MFB is provided on the surface of an audio apparatus 36 which is the same as the audio apparatus 36 as shown in FIG. 16. Low-pitched tones reproduced by woofers 14L, 14R in the left and right speaker boxes 1L, 1R are detected by the microphone 10 on the audio apparatus 36 provided centrally between the speaker boxes 1L, 1R and fed back to the power amplifier. In FIG. 19, the reproduced sounds of woofers 14L, 14R are detected by the microphone 10. A low-pitched tone signal is derived from a low pass filter 40 through a feedback circuit 16. This is fed back to the inverting input of each amplifier (subtractor) 41L, 41R. Equalizers 42L, 42R filter the wave at the feedback upper limit frequency of MFB. Power amplifiers 43L, 43R drive left and right woofers 14L, 14R. Reference numerals 44L, 44R denote input terminals.

If we consider the sound velocity as 340 m/s and the feedback upper-limit frequency as 100 Hz, the phase differences between the reproduced sounds of woofers 14L, 14R and the detected signal of the microphone 10 become 90° when the distances from the microphone 10 to woofers 14L, 14R are ¼ wavelength or 85 cm. Namely, the amount of feedback becomes zero. When the microphone 10 is separated from woofers 14L, 14R by more than 85 cm, the detection sensitivity of the microphone 10 decreases and the amount of feedback becomes less than or equal to 1. Therefore, even if the phase rotates more than 90°, neither positive feedback nor oscillation occurs.

Figure 20:
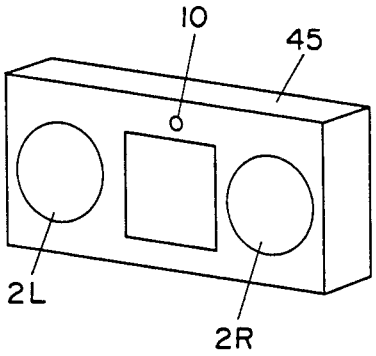
FIG. 20 is a perspective view of a seventh embodiment of this invention.

FIG. 20 shows a modification of FIG. 18. The invention is applied to a cassette tape recorder combined with a radio and a compact stereo, etc. where left and right speakers 2L, 2R are accommodated in a common cabinet 45. In this case, the microphone 10 for MFB is provided in the center part of the cabinet 45. Furthermore, since the distances between the microphone 10 and the speakers 2L, 2R are fixed, the desired characteristics are advantageously guaranteed in a single manner simply.

Embodiments of FIGS. 18 to 20 have an extremely large utility, since a plurality of microphones are not required to apply MFB in an audio apparatus having a plurality of reproduction systems. Rather MFB is achieved with only one microphone. Further, when the low pass filter 40 of FIG. 19 has an upper limit frequency of 100 Hz, the sound image of stereo reproduction is defined or localized without any substantial damage. Moreover, in the case of MFB by acceleration feedback, a reduction of the lowest resonance frequency of speakers can be attained cheaply. Furthermore, the embodiments of FIGS. 18 to 20 have an extremely large effect in reducing the lowest resonance frequency in cassette tape recorders combined within a radio with a small type cabinet, etc.

In the first to seventh embodiments of the invention hereinabove described, an essential feature of the invention lies in the fact that a microphone is disposed in a plane which is substantially perpendicular to the radiation direction of the speaker and which contains substantially the acoustic center of the speaker, and the fact that the output of the microphone is fed back to a power amplifier in a frequency range lower than a frequency at which the distance between the speaker and the microphone is equal to $\frac{1}{4}$ wavelength.

Although in the above embodiments the output signal of the microphone is directly fed back to the power amplifier, it is needless to say that the lowest resonance frequency and its sharpness $Q_o$ can be varied by the feedback through an integration circuit, by the velocity feedback or by the amplitude feedback.

INDUSTRIAL APPLICABILITY

As described above, according to this invention, a speaker apparatus is realized, wherein the detection by a microphone or an MFB detecting element has no influence on the reproduction of sound; limitation of speaker design is minimal; design or external appearance is excellent; the feedback upper limit frequency is high; and the influence of Doppler distortion is small.

I claim:

1. A speaker apparatus comprising:

an input terminal for receiving an input signal;

a speaker for radiating a sound wave, said speaker having a sound wave radiation axis;

a power amplifier connected between said input terminal and said speaker for driving said speaker to produce a sound wave;

a feedback amplifier;

a microphone for detecting the sound wave from said speaker and connected to said power amplifier via said feedback amplifier for feeding back to said power amplifier a feedback signal which has a frequency range below an upper limit frequency, said microphone being disposed in a plane which is substantially perpendicular to the direction of said sound wave radiation axis, and wherein said plane substantially contains an acoustic center of said speaker and said microphone is located at a distance from said sound radiation axis which is not greater than $\frac{1}{4}$ of the wavelength corresponding to the upper limit frequency of the feedback signal.

2. A speaker apparatus according to claim 1, further comprising a speaker box having a baffle plate and wherein said speaker and said microphone are both mounted on said baffle plate.

3. A speaker apparatus according to claim 2, wherein said speaker includes a speaker component for low-pitched tones and a speaker component for high-pitched tones, both said speaker components and said microphone being mounted on said baffle plate with said microphone being mounted adjacent to said speaker component for low-pitched tone.

4. A speaker apparatus according to claim 1, and further comprising a cabinet having a front panel, and at least one of a radio and a tape recorder mounted in said cabinet, wherein said speaker and microphone are both mounted on said front panel.

5. A speaker apparatus according to claim 1, and further comprising a speaker box and a cabinet which is separate and independent from said speaker box, said speaker being mounted on said speaker box and said microphone being mounted on said cabinet.

6. A speaker apparatus according to claim 5, wherein said cabinet contains a feedback circuit connected to the output of said microphone.

7. A speaker apparatus according to claim 5, wherein said cabinet contains said power amplifier and a feedback circuit connected between said microphone and said power amplifier.

8. A speaker apparatus according to claim 5, wherein said cabinet includes an audio apparatus containing a tuner and a tape recorder.

9. A speaker apparatus according to claim 1, further including a speaker box, and wherein said speaker includes a speaker component for high-pitched tones and a speaker component for low-pitched tones, both said speaker components being mounted on said speaker box and each said speaker component having a sound radiation axis, said plane in which said microphone is disposed is substantially perpendicular to the sound radiation axis of said speaker component for low-pitched tones and contains the acoustic center of said speaker component for low-pitched tones, and said microphone is disposed on the sound radiation axis of said speaker for high-pitched tones.

10. A speaker apparatus according to claim 1, wherein said speaker includes a speaker component for high-pitched tones and a speaker component for low-pitched tones, both said speaker components being disposed coaxially relative to one another, and said microphone is disposed at a position which is substantially the acoustic center of both said speaker components.

11. A speaker apparatus according to claim 1, wherein said speaker includes two speaker components each for a respective one of two channels and each having a sound radiation axis, and said plane is substantially perpendicular to the sound wave radiation axis of each of said speaker components and contains the acoustic center of each of said speaker components.

* * * * *